US009492760B2

(12) United States Patent
Randall

(10) Patent No.: US 9,492,760 B2
(45) Date of Patent: Nov. 15, 2016

(54) METHOD AND APPARATUS FOR PRODUCING AMBULATORY MOTION

(76) Inventor: Mitch Randall, Boulder, CO (US)

( * ) Notice: Subject to any disclaimer, the term of this patent is extended or adjusted under 35 U.S.C. 154(b) by 675 days.

(21) Appl. No.: 12/986,150

(22) Filed: Jan. 6, 2011

(65) Prior Publication Data

US 2011/0165821 A1 Jul. 7, 2011

Related U.S. Application Data

(60) Provisional application No. 61/292,745, filed on Jan. 6, 2010.

(51) Int. Cl.
*A63H 11/00* (2006.01)
*A63H 11/20* (2006.01)

(52) U.S. Cl.
CPC ..... *A63H 11/205* (2013.01); *A63H 11/00* (2013.01)

(58) Field of Classification Search
CPC .... A63H 11/00; A63H 11/20; A63H 11/205; A63H 11/18; A63H 31/08; A63H 2011/16; B62D 57/00; B62D 57/02; B62D 57/032
USPC ..... 446/330, 353–356, 368, 377, 390, 376
See application file for complete search history.

(56) References Cited

U.S. PATENT DOCUMENTS

| | | | | |
|---|---|---|---|---|
| 54,518 A | | 5/1866 | Field | |
| 1,511,928 A | | 10/1924 | Zboril | |
| 1,574,679 A | | 2/1926 | Nilsson | |
| 2,827,735 A | * | 3/1958 | Grimm, Jr. | A63H 11/20 180/8.6 |
| 2,989,265 A | | 6/1961 | Selsted | |
| 3,331,463 A | * | 7/1967 | Kramer | B62D 57/032 180/8.6 |
| 3,680,395 A | | 8/1972 | Douglas | |
| 3,712,554 A | | 1/1973 | Lorenzini et al. | |
| 4,441,663 A | | 4/1984 | Welch et al. | |
| 4,503,924 A | | 3/1985 | Bartholet et al. | |
| 4,527,650 A | | 7/1985 | Bartholet | |
| 4,629,440 A | * | 12/1986 | McKittrick, Jr. | A63H 11/20 180/8.6 |
| 4,662,465 A | | 5/1987 | Stewart | |
| 4,697,755 A | | 10/1987 | Kataoka | |
| 4,738,583 A | | 4/1988 | Macconochie et al. | |
| 4,939,944 A | * | 7/1990 | Hou | F16H 21/36 428/16 |

(Continued)

FOREIGN PATENT DOCUMENTS

| | | |
|---|---|---|
| JP | 60-259580 | 12/1985 |
| JP | 63-89275 | 4/1988 |

(Continued)

OTHER PUBLICATIONS

Non-Final Office Action mailed Jun. 6, 2004, in U.S. Appl. No. 10/613,915, filed Jul. 2, 2003.

(Continued)

*Primary Examiner* — Gene Kim
*Assistant Examiner* — Alyssa Hylinski
(74) *Attorney, Agent, or Firm* — James R. Young; Cochran Freund & Young LLC

(57) ABSTRACT

Apparatus for ambulatory motion includes an exit slot of non-zero width and a bar or leg of non-zero and non-uniform width extending through the slot and connected to a crank constrains the bar or leg in a manner that produces nearly rectilinear motion of a distal end of the bar or leg when a proximal end of the bar or leg is connected to a crank and the crank is rotated.

14 Claims, 17 Drawing Sheets

(56) References Cited

U.S. PATENT DOCUMENTS

| | | | | |
|---|---|---|---|---|
| 5,040,626 | A | 8/1991 | Paynter | |
| 5,121,805 | A | 6/1992 | Collie | |
| 5,124,918 | A | 6/1992 | Beer et al. | |
| 5,248,107 | A | 9/1993 | Sumida et al. | |
| 5,256,232 | A | 10/1993 | Fuss et al. | |
| 5,423,708 | A * | 6/1995 | Allen | B62D 57/032 180/8.6 |
| 5,690,264 | A | 11/1997 | Distefan et al. | |
| 5,762,153 | A | 6/1998 | Zamagni | |
| 5,857,533 | A | 1/1999 | Clewett | |
| 6,238,264 | B1 * | 5/2001 | Kazami | A63H 11/205 446/356 |
| 6,488,560 | B2 * | 12/2002 | Nishikawa | A63H 11/205 446/330 |
| 6,602,106 | B2 | 8/2003 | Cheung | |
| 6,866,557 | B2 * | 3/2005 | Randall | A63H 11/205 446/330 |
| 7,938,708 | B2 * | 5/2011 | Willet | A63H 11/205 446/330 |
| 7,946,902 | B2 * | 5/2011 | Willett | A63H 17/006 446/353 |

FOREIGN PATENT DOCUMENTS

| | | |
|---|---|---|
| JP | 04-118404 | 4/1992 |
| WO | WO 2007130665 A2 * | 11/2007 |

OTHER PUBLICATIONS

International Search Report mailed Dec. 11, 2003, in PCT/US03/21227.

International Search Report for PCT/US2011/020427, Mailed Apr. 14, 2011, pp. 1-8.

* cited by examiner

METHOD AND APPARATUS FOR PRODUCING AMBULATORY MOTION

BACKGROUND OF THE INVENTION

1. Field of the Invention

The present invention relates to a mechanism that produces ambulatory motion.

2. Description of the Related Art

The present invention relates to an improved method and apparatus for producing ambulatory motion. The U.S. Pat. No. 6,866,557, which is incorporated herein by reference for all that it discloses, describes a method and apparatus whereby uniform rectilinear motion is produced at the distal end of a bar driven by a circular crank at the opposite end and constrained by a slideable pivot at a point located between the ends of the bar. In that apparatus, the bar follows the pivot point such that a centerline of the bar extending from the distal end to the proximal end intersects the fixed pivot point.

The foregoing example of the related art and limitations related therewith are intended to be illustrative and not exclusive. Other limitations of the related art will become apparent to those of skill in the art upon a reading of the specification and a study of the drawings.

BRIEF DESCRIPTION OF THE DRAWINGS

The accompanying drawings, which are incorporated herein and form a part of the specification, illustrate some, but not the only or exclusive, example embodiments and/or features. It is intended that the embodiments and figures disclosed herein are to be considered illustrative rather than limiting.

In the Drawings.

DETAILED DESCRIPTION OF EXAMPLE IMPLEMENTATIONS

The present invention includes a method and apparatus comprising an exit slot of non-zero width and a bar of non-zero and varying width to approximate a constraining action instead of a slideable pivot formed by a slot and a pin in the U.S. Pat. No. 6,866,557. This method and apparatus can be implemented in such a way as to be more robust while also considering the non-zero dimension of the distal end of a leg or other component which is in contact with a surface upon which the device is ambulating. In the slot on pin apparatus of U.S. Pat. No. 6,866,557, some implementations, for example, smaller or more compact toys or other implementations, may be constrained or impractical due to the proportions of components, such as the distance between the crank axis and the pivot point being only slightly greater than the crank radius, small pivot pins being subject to wear and breakage, especially in implementations where a gear is used as the crank and the teeth of the gear interfere with or prohibit use of a larger pivot pin.

One problem with the prior art is that the distance from the crank axis to the pivot point is only slightly greater than the crank radius. This constrains practical implementations. In some cases the pivot pin required is small and can be readily damaged. In other cases where a gear is used as the crank, the teeth of the gear can interfere with reasonably sized pivot pin.

What is needed is a means of constraining the lever to slideably pivot about a point or approximate such motion without the need for a fragile and unreliable pivot pin.

The following embodiments and aspects thereof are described and illustrated in conjunction with systems, tools and methods which are meant to be examples and illustrative, not limiting in scope. In various example implementations and embodiments, one or more of the above-described problems have been reduced or eliminated, while other example embodiments are directed to other improvements.

Figure 1:
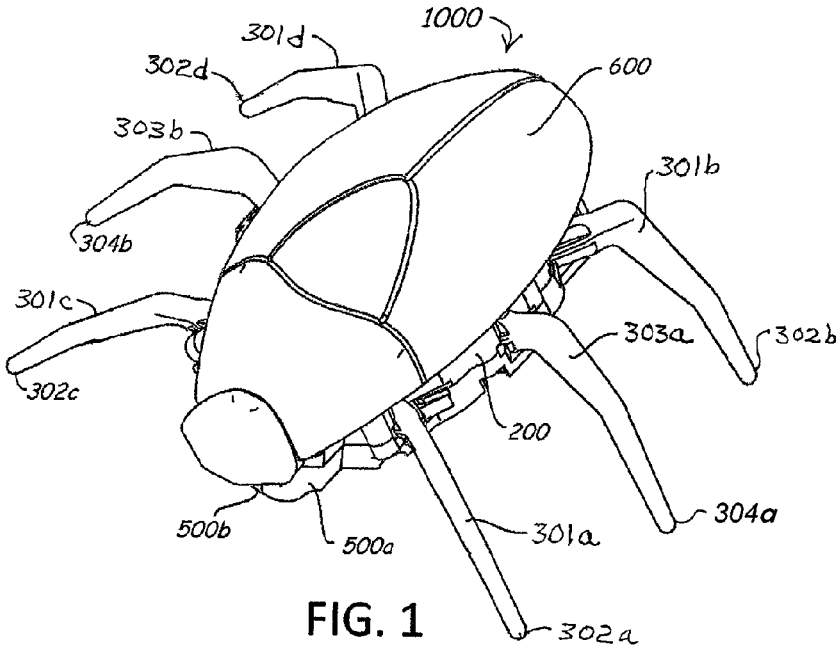
FIG. 1 is a perspective view of an example walking toy employing six leg mechanisms implemented with apparatus and methods according to this invention.
Figure 2:
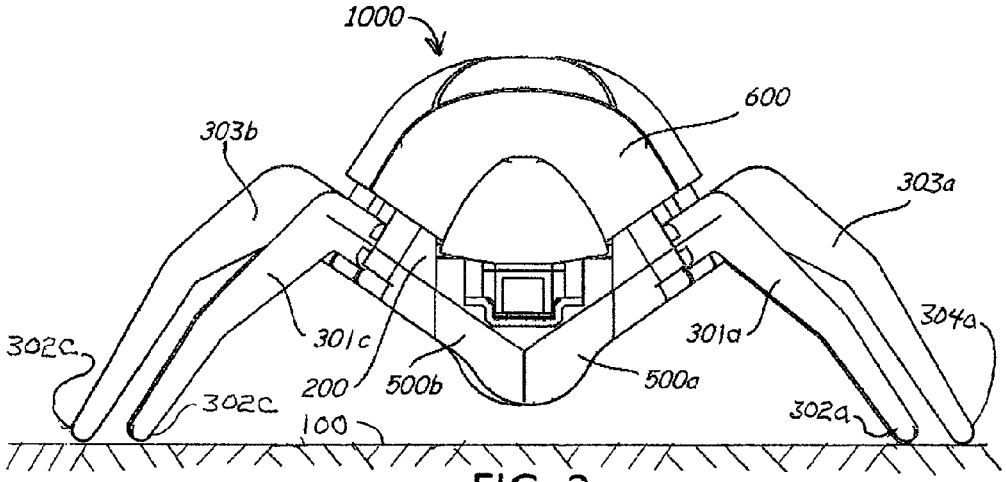
FIG. 2 is a front evaluation view of the example walking toy in FIG. 1.

FIGS. 1 and 2 show an example walking device 1000 in the form of a toy robot bug with a mechanism designed to produce ambulatory motion although the mechanism can be used with other devices for other purposes. This example embodiment 1000 uses a basic crank/pivot/bar scheme tilted at a slight angle such that when each leg 301*a*, 301*b*, 301*c*, 301*d*, 303*a*, 303*b* extends during its respective step, the distal ends 302*a*, 302*b*, 302*c*, 302*d*, 304*a*, 304*b* of the respective legs 301*a*, 301*b*, 301*c*, 301*d*, 303*a*, 303*b* lifts from the surface 100 in a sequence that leaves enough of the legs on the surface 100 at any particular time to provide a stable support for the device 1000 as one or more of the other legs have their distal ends lifted and moved in a stride motion in relation to the body of the toy 1000. In the example shown, this slight tilt angle is 33.4 degrees from horizontal. However, other angles can also be used to meet various design objectives. Also, more or fewer than six legs can be used.

A shell 600 covers the upper portion of the device 1000 which in some cases may also contain control electronics and batteries. Top housing 200 and bottom housing 500*a*, 500*b* enclose the mechanism that provides the motion to the legs 301*a*, 301*b*, 301*c*, 301*d*, 303*a*, 303*b*.

The shape of shell 600 can be a design element or can function as a protective enclosure for control electronics, battery, or other components of the walking device. In some cases it can be both a design element and a functional enclosure.

Figure 3:
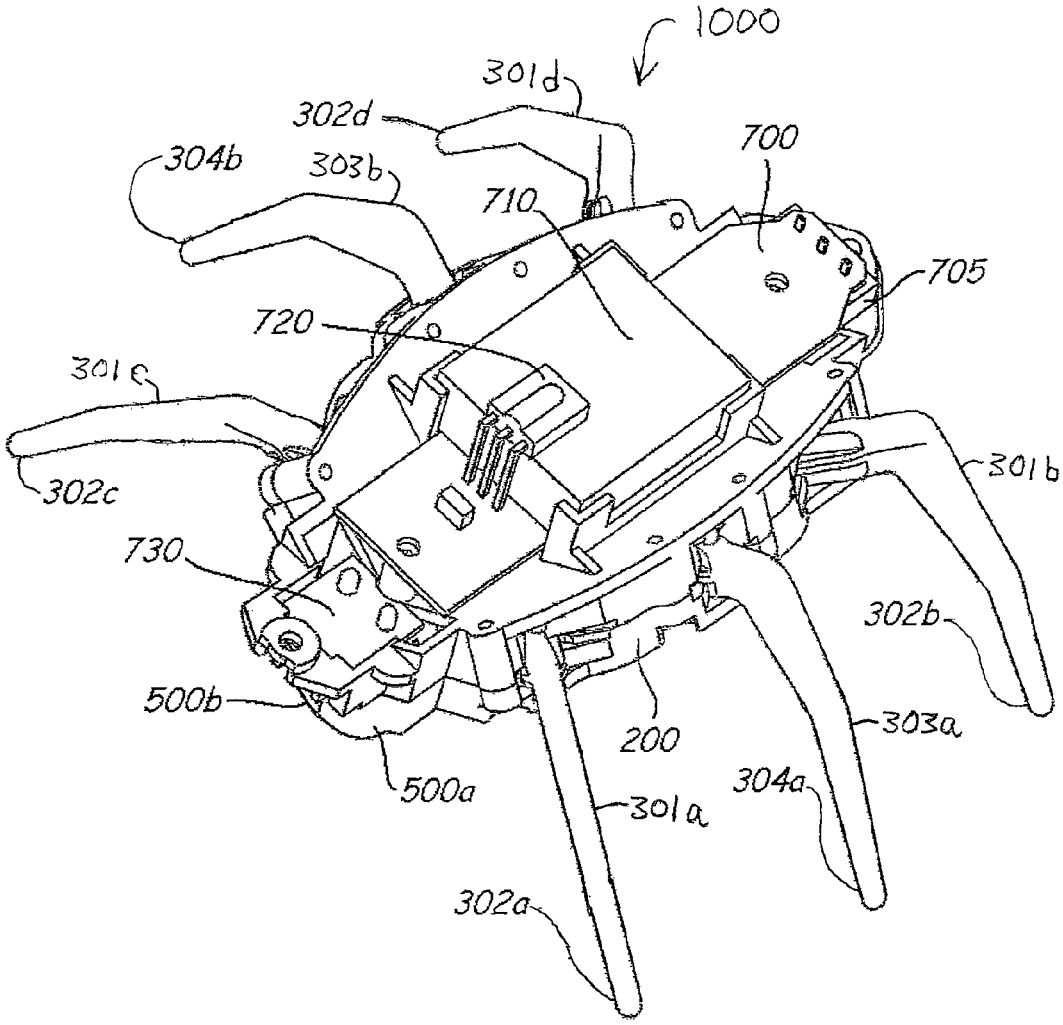
FIG. 3 is a perspective view of the example walking toy in FIGS. 1 and 2, but without the shell in order to reveal components within.

FIG. 3 shows a perspective view of this example embodiment of the device 1000 with the shell 600 removed. In this embodiment, printed circuit board 700 holds several components required to control the device. A switch 705 allows power to be switched on and off. Battery 710 provides the source of power. Receiver 720 receives infra red signals from a controller (not shown). Daughter board 730 holds a connector used to recharge battery 710. These example electronic and control components can be designed for various functions by persons skilled in the art, once they understand this invention, for example, start, stop, forward, reverse, fast, slow, turn left, turn right, and others for various purposes. However, such functions and controls are not part of this invention, so no further description of them is needed here for an understanding of this invention.

Figure 4:
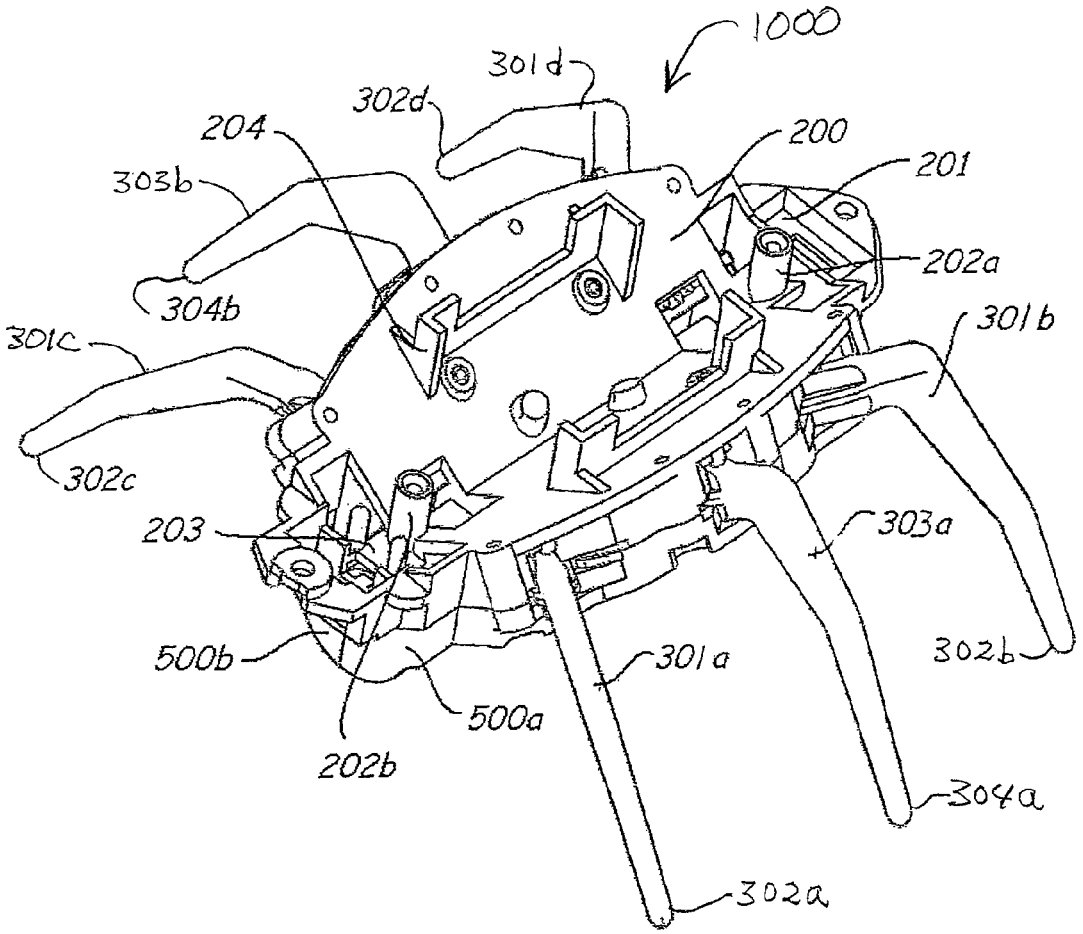
FIG. 4 is another perspective view of the example walking toy without the shell and without the electronic components and battery in order to reveal more of the example components and structures of the toy.

FIG. 4 shows a perspective view of this example device embodiment 1000 with several control components removed. Feature 204 is used to hold battery 710. Standoffs 202*a*, 202*b* are used to hold printed circuit board 700. Features 203 hold the daughter board 730.

Figure 5:
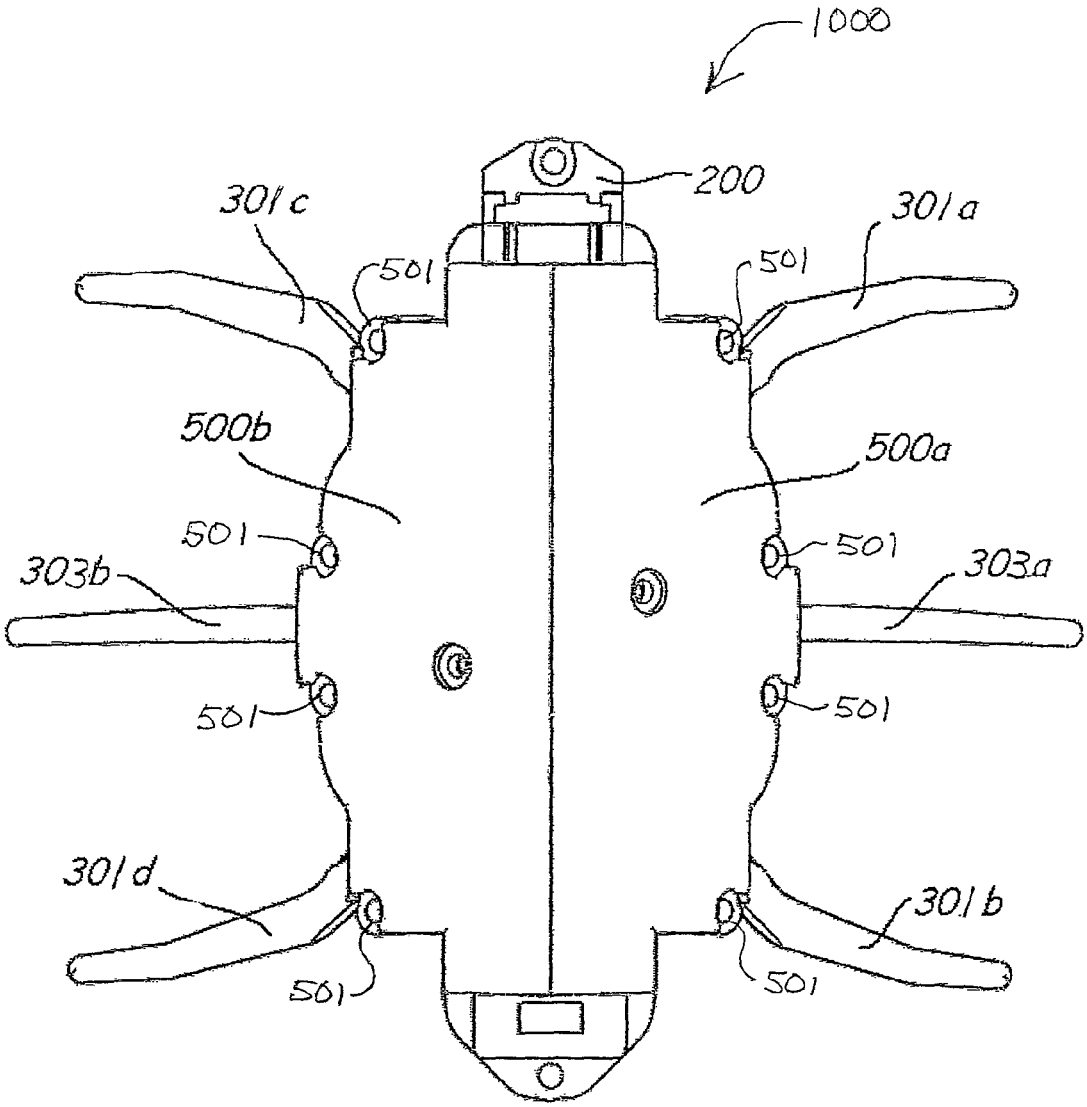
FIG. 5 is a bottom plan view of the example walking toy.

FIG. 5 shows the bottom of this example embodiment where bottom housings 500*a*, 500*b* are visible. In this embodiment, the bottom housings 500*a*, 500*b* are affixed to the main housing 200 (FIG. 4) with ten screws. The screws are not shown in FIG. 5, but the holes and recesses, e.g., 501, in the bottom housings 500*a*, 500*b* for the screws can been seen in FIG. 5.

Figure 6:
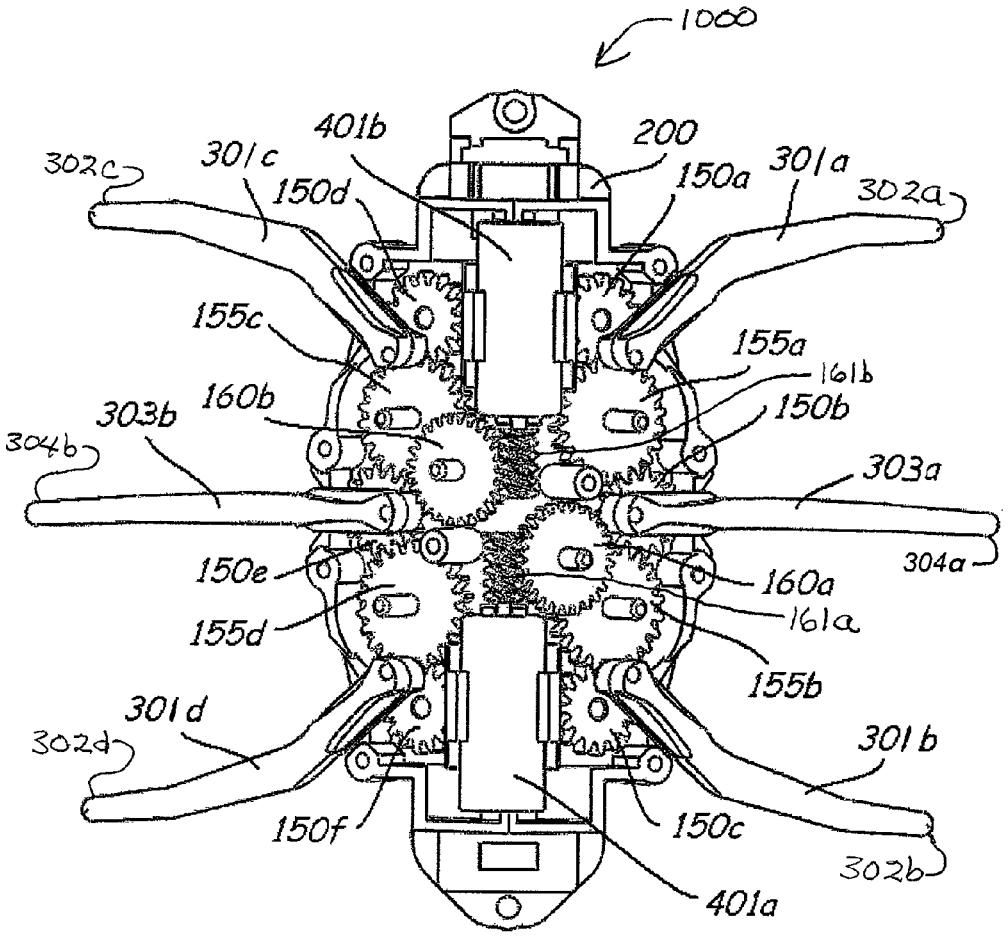
FIG. 6 is a bottom plan view of the example walking toy with the bottom covers removed in order to reveal the motor and gear drive mechanisms within.

FIG. 6 shows the example device 1000 with bottom housing 500*a*, 500*b* (FIG. 5) removed, revealing the details of the mechanism. The mechanism of the example walking device 1000 in this example embodiment comprises two independent sides. Legs 301*a*, 301*b*, and 303*a* are on the right side, and legs 301*c*, 301*d*, and 303*b* are on the left side. The legs of the right side move in synchronization with one another. The legs of the left side move in synchronization with one another. The legs of the left side move independently of the legs of the right side. In other implementations, other combinations of leg synchronzations and/or dependence or independence can be used.

In the example embodiment 1000, motor 401*b* drives reducer 160*b* through a worm gear 161*b*. Reducer 160*b* has 22 teeth in this example so it progresses one full revolution for every 22 turns of the motor 401*b* output shaft. Reducer 160*b* also has an eight tooth gear (which is on the underside of reducer 160*b*, thus cannot be seen in FIG. 6, but which is readily understood by persons skilled in the art) that engages idler 155*c*. Idler 155*c* engages crank gear 150*d* and 150*e*. Other gear ratios can be used. Crank gear 150*e* engages idler 155*d*, which in turn engages crank gear 150*f*. Thus when the output shaft of motor 401*b* turns, the three crank gears 150*d*, 150*e*, 150*f* turn synchronously with each other causing the left side legs 301*c*, 301*d*, and 303*b* to perform ambulatory motion. Other sized and configured gears and idlers can be used.

Similarly, motor 401*a* drives reducer 160*a* through a worm gear 161*a*. Reducer 160*a* engages idler 155*b* through an eight tooth pinion on the underside of idler 155*b*, thus not visible in FIG. 6. Idler 155*b* engages crank gear 150*c* and crank gear 150*b*. Crank gear 150*b* also engages idler 155*a*, which in turn engages crank gear 150*a*. Thus as the output shaft of motor 401*a* turns, the crank gears 150*c*, 150*b*, 150*a* on the right side move in unison to move legs 301*a*, 301*b*, and 303*a* to create ambulatory motion.

The motion of the legs 301*a*, 301*b*, 301*c*, 301*d*, 303*a*, 303*b* cause their respective distal ends 302*a*, 302*b*, 302*c*, 302*d*, 304*a*, 304*b* to engage with the surface 100 (FIG. 2) for two-thirds of their respective full cycles (corresponding to the respective crank 150*a*, 150*c*, 150*d*, 150*f*, 150*b*, 150*e* turning one full revolution). In addition, the legs of a given side are synchronized to lead or lag the neighboring leg(s) by ⅓ of a full stepping cycle. Consequently, at any one time, four of the six distal ends of the legs will be engaged with the support surface 100 (FIG. 2). Thus, the walking device maintains balance at all times without the need to synchronize the left and right sides. The example walking device 1000 can thus be maneuvered by independently controlling the left and right sides. Other lead and lag settings can be used, for example, when more or fewer than six legs are used.

Figure 7:
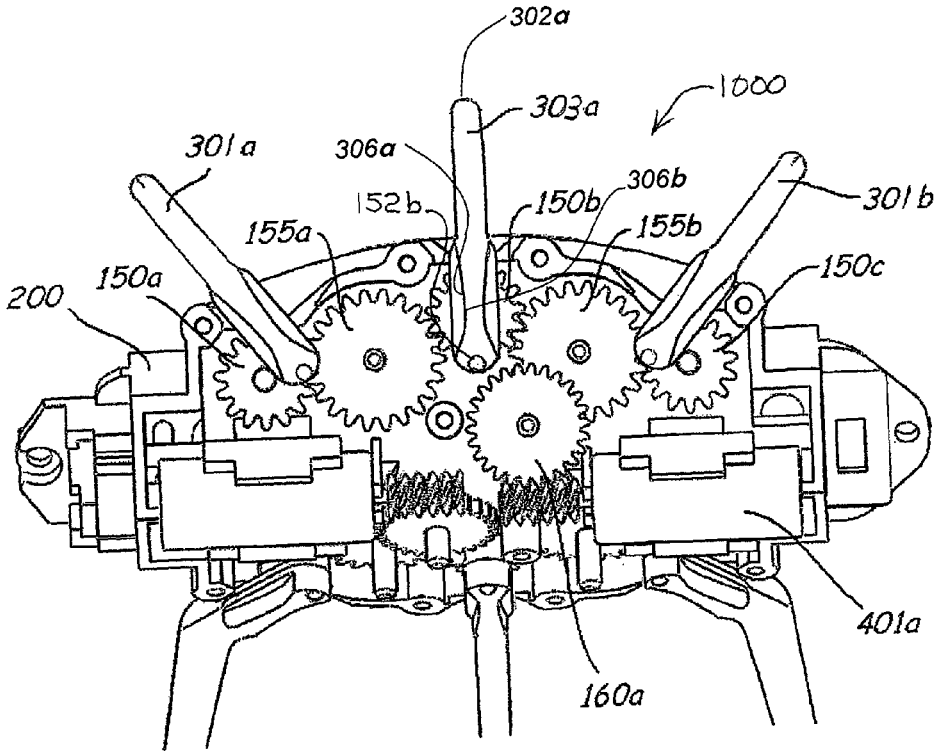
FIG. 7 is a view of the gear train of the example walking toy.

FIG. 7 shows a normal view of the mechanism of the left side of the example embodiment 1000, i.e., perpendicular to the axes of rotation of the cranks 150*a*, 150*b*, 150*c*. The right side of the embodiment is symmetrical to the left side, thus discussions of operation pertain to both sides.

The crank gears 150*a*, 150*b*, 150*c* provide the crank motion required to move the respective legs 301*a*, 303*a*, 301*b* as explained above. Taking the center leg 303*a* as an example, the crank gear 150*b* provides crank pin 152*b* (see FIG. 8) to drive leg 303*a*.

Figure 8:
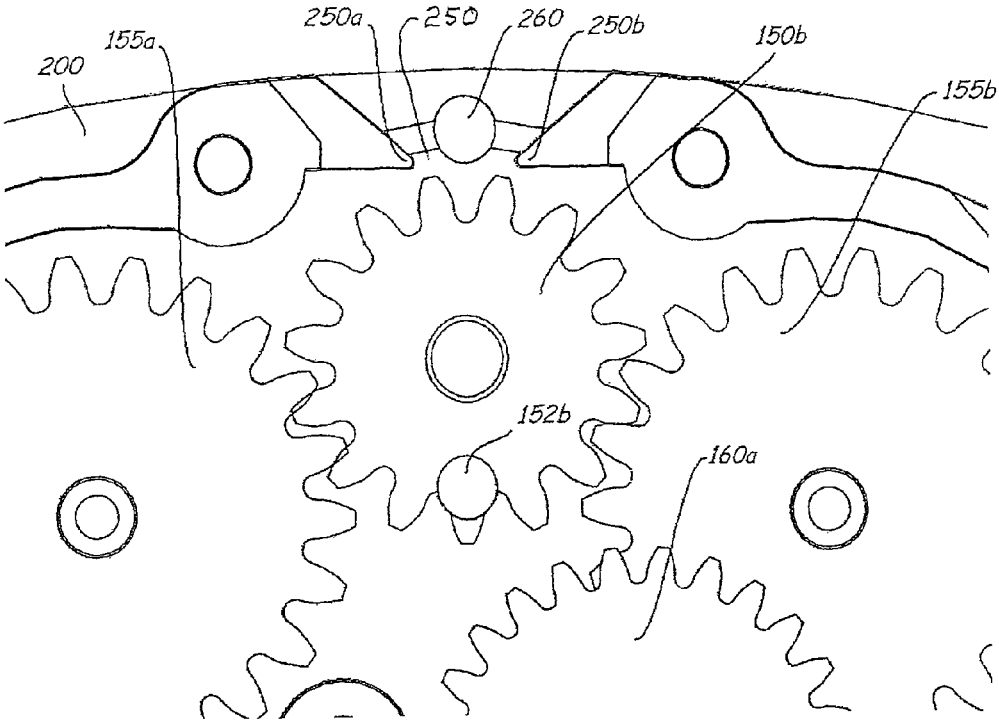
FIG. 8 is a close up view of the gear train with the center leg on one side removed to reveal additional components and features.
Figure 11:
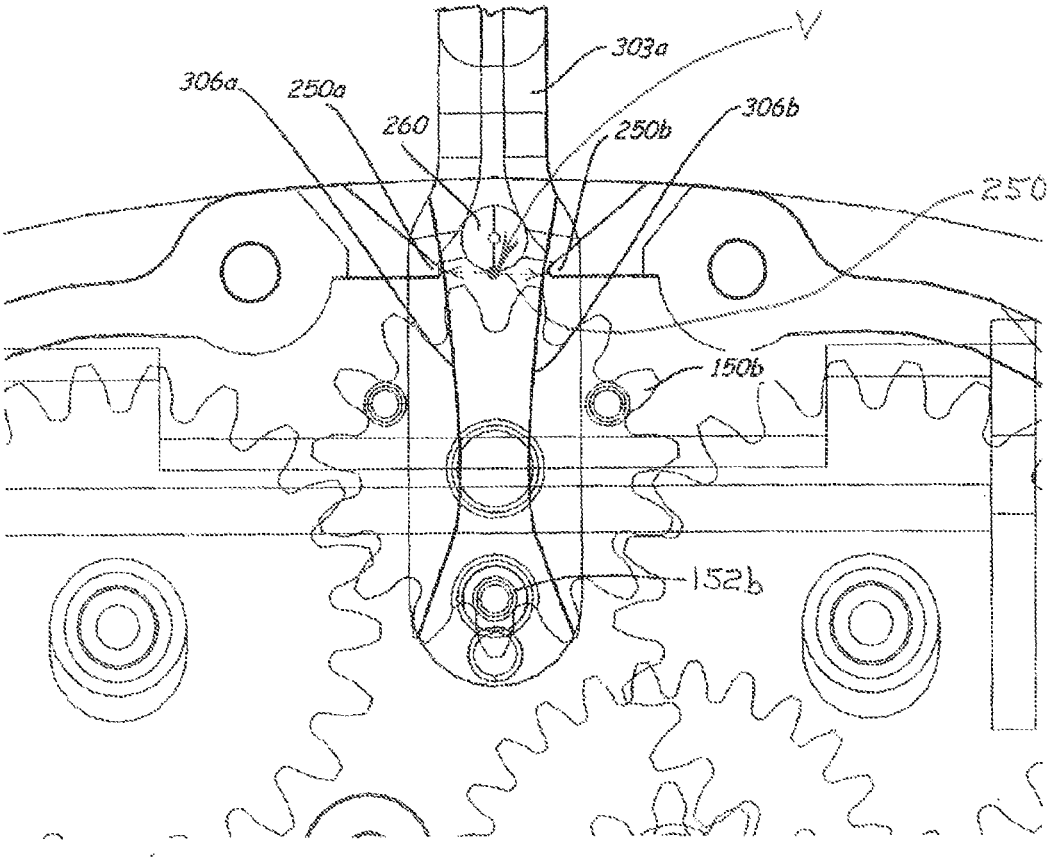
FIG. 11 is a phantom view normal to one of the leg drive cranks showing how the profile of the leg fits within the slot in the housing when the crank is at zero degrees.
Figure 12:
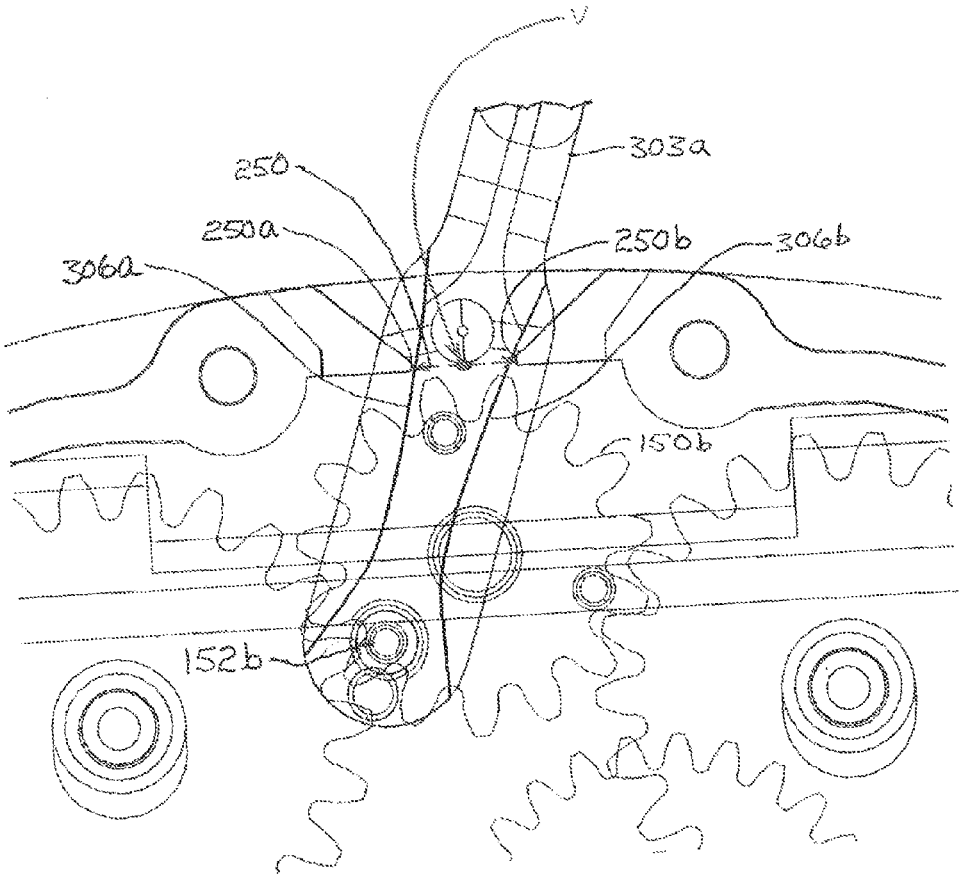
FIG. 12 is a phantom view normal to one of the leg drive cranks showing how the profile of the leg fits within the slot in the housing when the crank is at 45 degrees.
Figure 13:
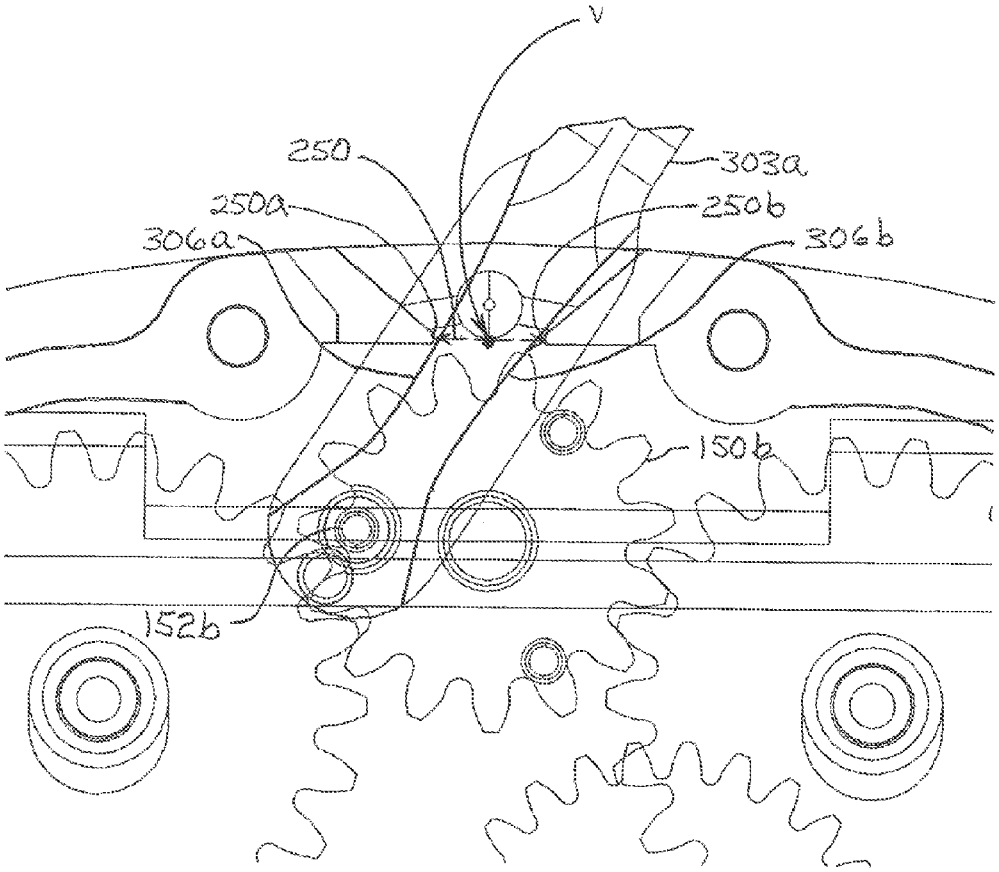
FIG. 13 is a phantom view normal to one of the leg drive cranks showing how the profile of the leg fits within the slot in the housing when the crank is at 90 degrees.
Figure 14:
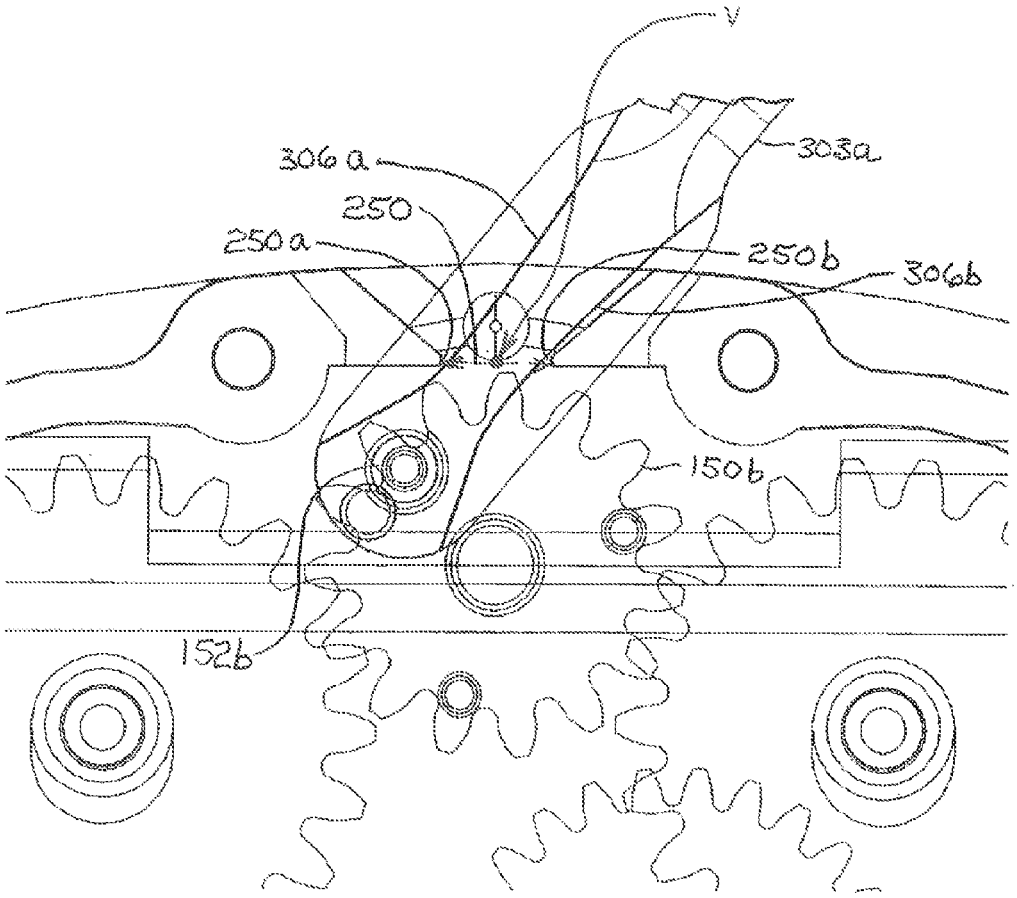
FIG. 14 is a phantom view normal to one of the leg drive cranks showing how the profile of the leg fits within the slot in the housing when the crank is at 135 degrees.
Figure 15:
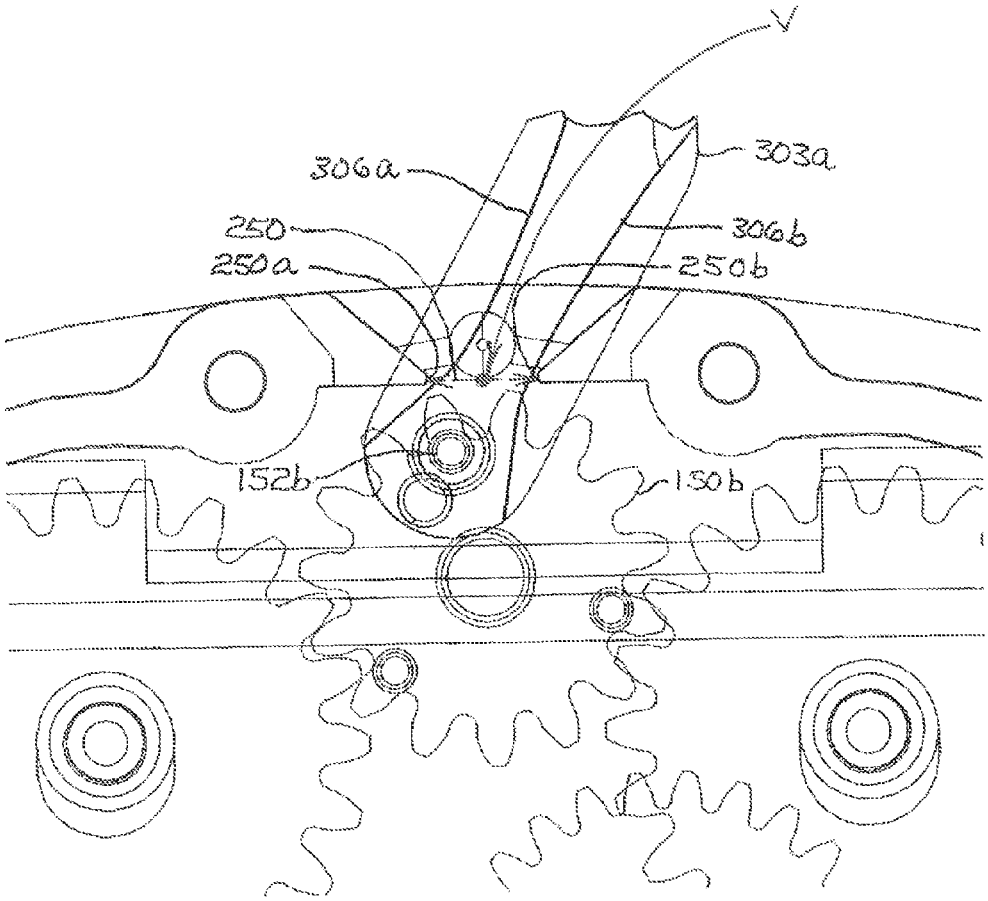
FIG. 15 is a phantom view normal to one of the leg drive cranks showing how the profile of the leg fits within the slot in the housing when the crank is at 150 degrees.

Referring to FIG. 8, a gap 250 is formed by wall radii 250*a* and 250*b*, which form opposing lateral bearings on opposite lateral sides of the gap 250 for bearing on the guide surfaces 306*a*, 306*b* (best seen in FIG. 11) of the leg 303*a* as the crank 150*b* rotates. This gap (herein referred to as gap 250) guides leg 303*a* as will be explained below. Referring now to FIG. 11 as well as FIG. 8, the curved profiles of the guide surfaces 306*a*, 306*b* of leg 303*a* are such that throughout the rotation of crank 150*b*, leg 303*a* is closely constrained within the gap 250 by the lateral bearings provided by radii 250*a*, 250*b*.

Figure 9:
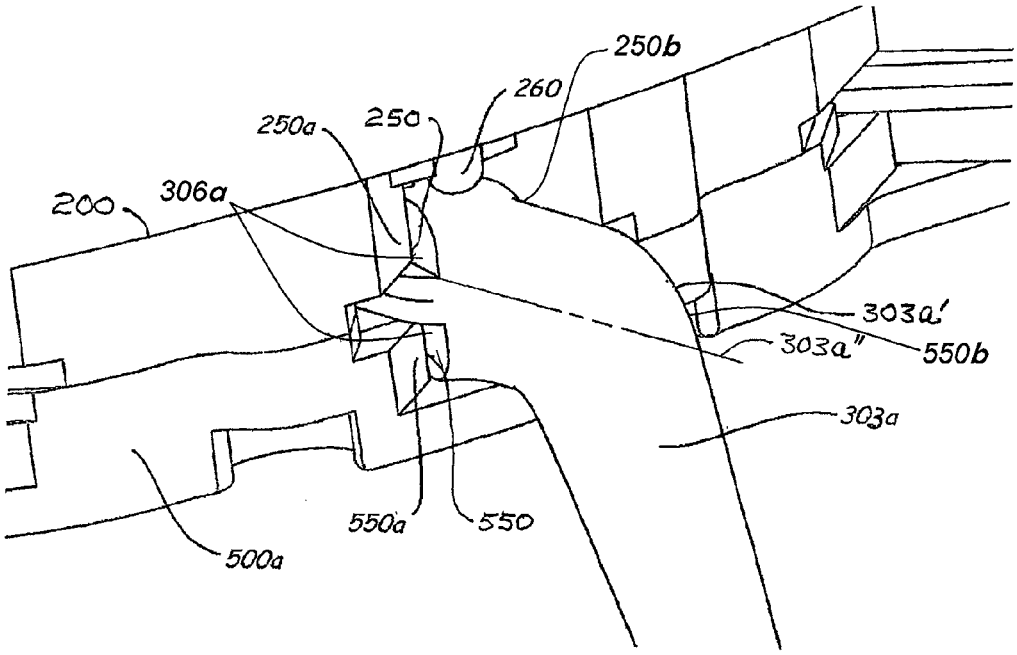
FIG. 9 is an enlarged perspective view of a portion of one side of the example walking toy showing an example leg and the leg mounting details.

FIG. 9 shows how both the top housing 200 and bottom housing 500*a* provide gap 250 and gap 550, which together provide an opening in the housing 200, 500*a* for passage of the leg 303*a* and to constrain leg 303*a* in this embodiment. The gap 550 in the bottom housing 500*a* is similar to gap 250 in the top housing 200, but formed by radii in the bottom housing 500*a* similar and juxtaposed to the radii 250*a*, 250*b* in the housing 200 to provide lateral bearings for constraining the leg 303*a*. One of such radii (radius 550*a*) in the bottom housing 500*a* that is similar and juxtaposed to the radius 250*a* in the top housing 200 can be seen in FIG. 9, but the other one that is similar and juxtaposed to the radius 250*b* in the top housing 200 is concealed from view in FIG. 9 by the leg 303*a*, as is the radius 250*b*. However, the lead lines 250*b* and 550*b* in FIG. 9 point in the directions where those features would be seen if they were not concealed by the leg 303*a*, as will be understood by persons skilled in the art in the context of FIG. 9 and the description above, The gaps 250, 550 accommodate protrusion of the leg 303*a* through the housings 200, 500*a* and the radii that form the gaps 250, 550 bear against the curved surfaces 306*a*, 306*b* (best seen in FIG. 11) on opposite lateral sides of the leg 303*a* in a manner that constrains the leg 303*a* against lateral movement, but allows longitudinal movement of the leg 303*a* (meaning in the lengthwise direction of the lea 303*a*) in the gaps 250, 550. The resulting motion of the leg 303*a* during a crank. revolution includes both longitudinal movement (meaning in the lengthwise direction of the leg 303*a*) and pivotal movement of the leg 303*a* in relation to the body 200, 500*a* as imposed by sliding movement of the curved guide surfaces 306*a*, 306*b*, on one or both of the radii 250*a*, 250*b*. The gap 250 and the curved guide surfaces 306*a*, 306*b* are sized and shaped so that both of the guide surfaces 306*a*, 306*b* are in sliding contact or very dose to sliding contact with the respective lateral bearings provided by the radii 250*a*, 250*b* with little or no slop between the guide surfaces 306*a*, 306*b* and the respective bearings 250*a*, 250*b*through most, if not all, of a revolution of the crank 150*b* (at least through one-half of a revolution of the crank 150*b*). With the leg 303*a* constrained in that manner, the leg 303*a*pivots about a fixed virtual pivot axis V between the radii 250*a*, 250*b* while the crank gear 150*b* moves the leg 303*a* in the lengthwise direction of the leg 303*a* inwardly and outwardly in relation to the body 200. The radii 250*a*, 250*b* form bearings that bear on opposite lateral sides 306*a*, 306*b*, respectively, of the leg 303*a*. The bearing 260 portion of housing 200 and the bottom housing 500*a* form respective top and bottom bearings that bear on respective top and bottom surfaces of the leg 330*a* that slide in the opening provided by the gaps 250, 550. The radii bearing on the leg opposite sides of the leg 303*a* also prevent the leg 303*a* from twisting, e.g., rotating about an imaginary line 303*a*" that extends through the knee 303*a*' to the crank pin 152*b*.

Figure 10:
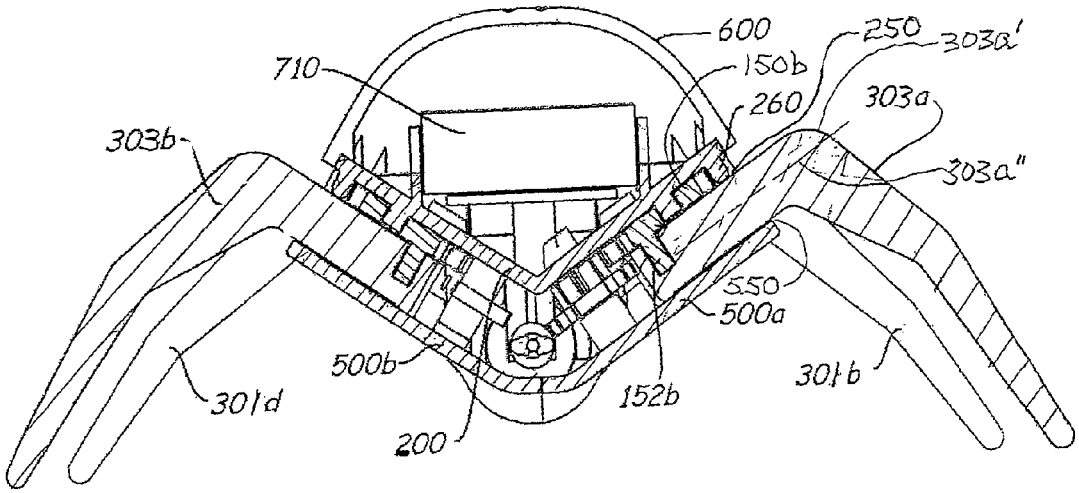
FIG. 10 is a cross sectional view of the example walking toy at the center leg section showing how the legs are captured by the top and bottom housing.

FIG. 10 shows a cross sectional view through the center of the gap 250, 550. In this view it can be seen that leg 303*a* is constrained in the plane of the cross section by bearing 260, crank pin 152*b*, and bottom housing 500*a* in a manner that prohibits lateral movement of the leg 303*a* in the plane of the cross-section perpendicular to the imaginary line 303*a*" while allowing longitudinal movement along the direction of the imaginary line 303*a*", since the bearing 260 and the bottom housing 500*a* bear slidably on respective opposite (e.g., upper and lower) surfaces of the leg 303*a*.

The FIGS. 11, 12, 13, 14, 15, and 16 show leg 303*a* sequentially at various positions of crank gear 150*b*. Since the radii in the bottom housing 500*a* that form the gap 550 are similar to the radii 250*a*, 250*b*, which form the gap 250 in the top housing 200, and bear against the guide surfaces 306*a*, 306*b* in the same manner, this description proceeds below with reference only to the radii 250*a*, 250*b* and gap 250 in the top housing 200 as best seen in FIGS. 11-16 to avoid cumbersome repetition, but recognizing that the description applies to the gap 550 in the bottom housing 500*a* as well. Because of the symmetry of the mechanism, the motion due to the crank gear 150*b* need only be shown for ½ of a revolution, e.g., from 0 ° through 180° of rotation. It can be seen from the FIGS. 11-16 that throughout the 180 degree rotation of the crank gear 150*b*, curves 306*a*, 306*b* constrain leg 303*a* slidably within slot 250 as explained above. It has been found that play or slop in the interface between leg 303*a* and slot 250 can be reduced to effectively zero or near zero for nearly all angles of the drive gear 150*b*, thus constraining the virtual pivot axis V of the leg 303*a* to a fixed location between the radii 250*a*, 250*b* or nearly all angles of the drive gear 150*b*, except where the crank pin 152*b* is near top dead center shown in FIG. 16.

Figure 16:
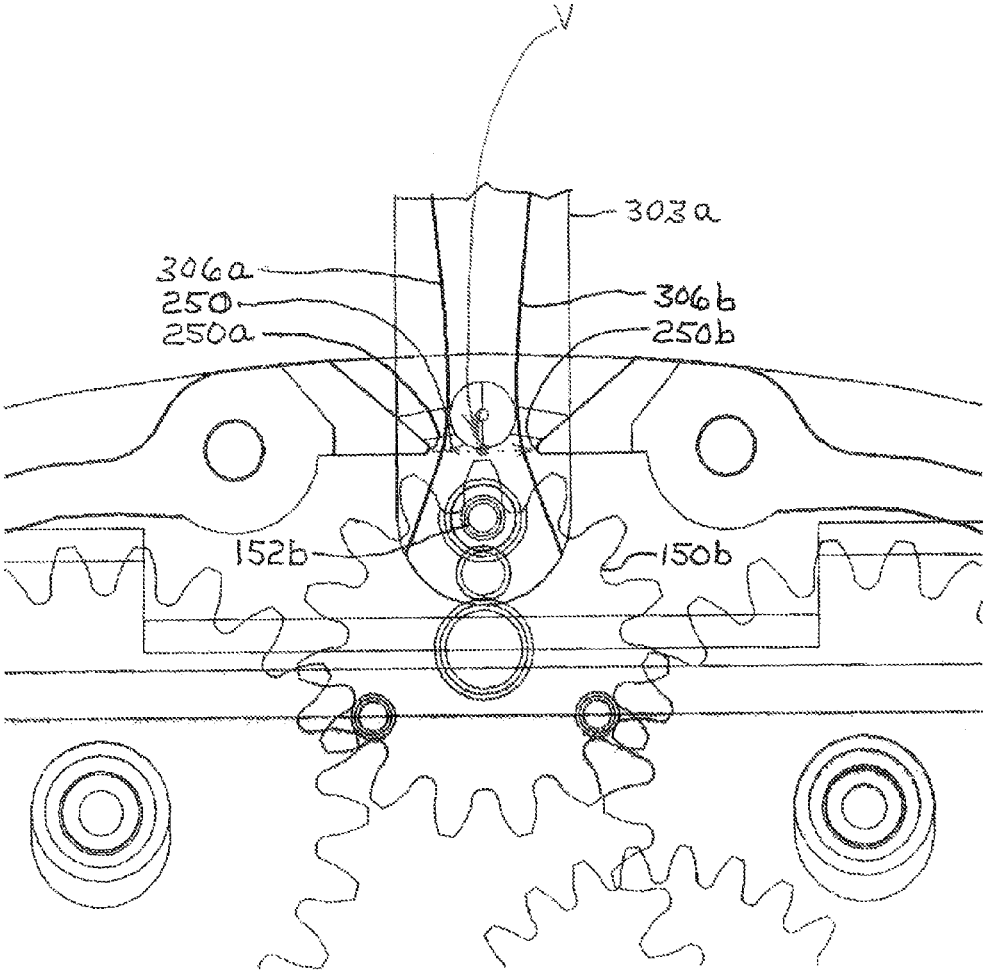
FIG. 16 is a phantom view normal to one of the leg drive cranks showing how the profile of the leg fits within the slot in the housing when the crank is at 180 degrees.
Figure 17:
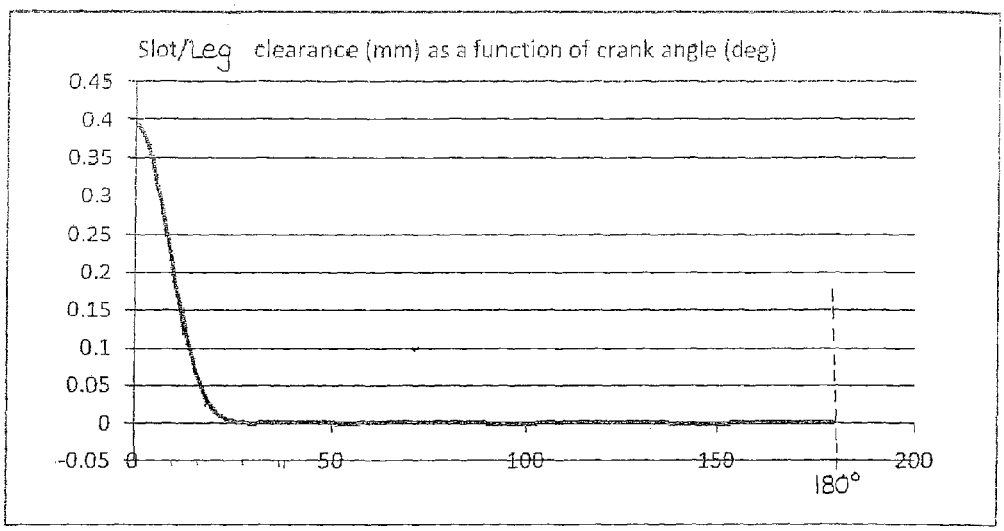
FIG. 17 is a graph showing the clearance between the slot and the thigh profile (in mm) as a function of the crank angle from zero to 180 degrees.

FIG. 17 is a graph of an example workable clearance between leg 303*a* and slot 250 as a function of the crank gear 150*b* angle of rotation from 0 to 180 degrees. For the graph in FIG. 17, zero degrees is defined by the crank gear 150*b* at top dead center as shown in FIG. 16 and continuing rotation 180 degrees to the position shown in FIG. 11. As shown in FIG. 17, the clearance does not exceed 0.4 mm in this example anywhere during the rotation of the crank 150*b* and is at or practically zero for about 150 degrees of a half of a rotation, i.e., 180 degrees, of the crank 150*b*. For practical purposes, it is preferred that the clearance not exceed 0.5 mm during a revolution and that it is less than about 0.1 mm for at least 150 degrees of a half of a revolution of the crank 150*b*, thus less than 0.1 mm during at least two 150 degree intervals of a full revolution.

Figure 18:
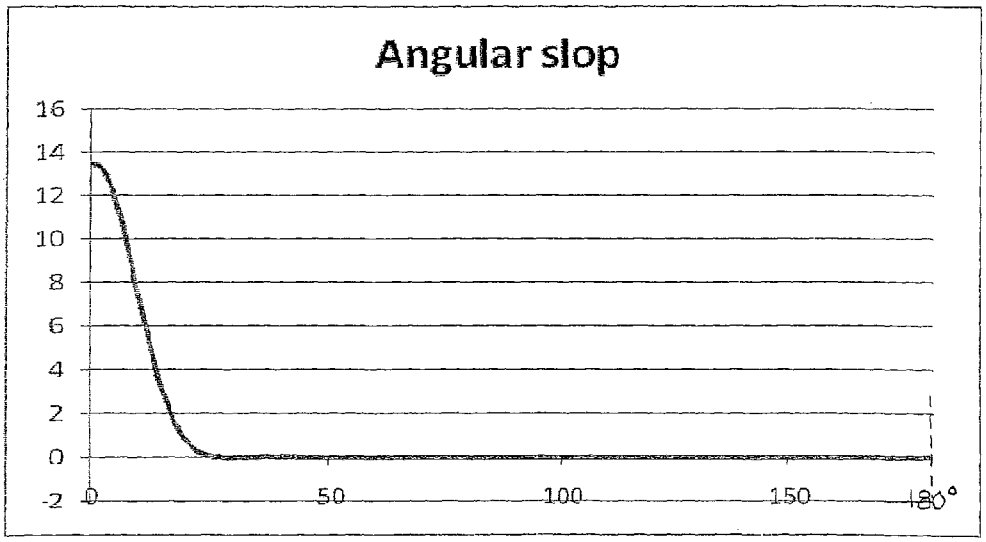
FIG. 18 is a graph showing the clearance between the slot and the thigh profile in terms of angular slop as a function of the crank angle from zero to 180 degrees.

The same clearance can be expressed in terms of the angular slop of leg 303*a*. This is defined by the angle swept by leg 303*a* with crank gear 150*b* held at a fixed angle (given by the ordinate of FIG. 18).

The results of this constrained motion set the distal end 304*a* of leg 303*a* in uniform rectilinear motion, or a close approximation thereof for about two-thirds of a full revolution of the crank 150*b* and crank pin 152*b* as explained above. By comparison of the U.S. Pat. No. 6,866,557 the motion of the leg 303*a* and distal end 304*a* is quite similar for similar choices of crank radius, pivot distance from crank axis, and leg thigh length. However, the constrained motion of leg 303*a* of this example implementation is not identical to the motion obtained through the use of a pivot and elongated slot of U.S. Pat. No. 6,866,557. Nevertheless, the motion obtained by the method and apparatus of this example implementation is a very close approximation to such uniform rectilinear motion.

One aspect of this invention also provides for accounting for the non-zero dimension of the distal end 304*a* of leg 303*a*. The distal end 304*a* (foot) of leg 303*a* can be spherical or assumed to be spherical which allows for the roll of the foot along a surface 100 (FIG. 1) as per the angle of leg 303*a* through the stride rectilinear portion of the motion of leg 303*a* in a predictable and describable way. The stride portion 351 (shown in FIG. 19) of the crank cycle is when the distal end 304*a* moves in the substantially rectilinear or near rectilinear motion in relation to the housings 200, 500*a*, and the step portion 353 of the crank cycle (shown in FIG. 19) is when the distal end 304*a* lifts or raises in relation to the housings 200, 500a and returns to the beginning of another stride portion. See, e.g., FIG. 19 which illustrates one half of a crank cycle—the other half being symmetrical with the illustrated half Therefore, the non-zero dimension of the foot can be accounted for and included when choosing optimal dimensional parameters required to approximate uniform rectilinear motion in a particular design or application.

Figure 19:
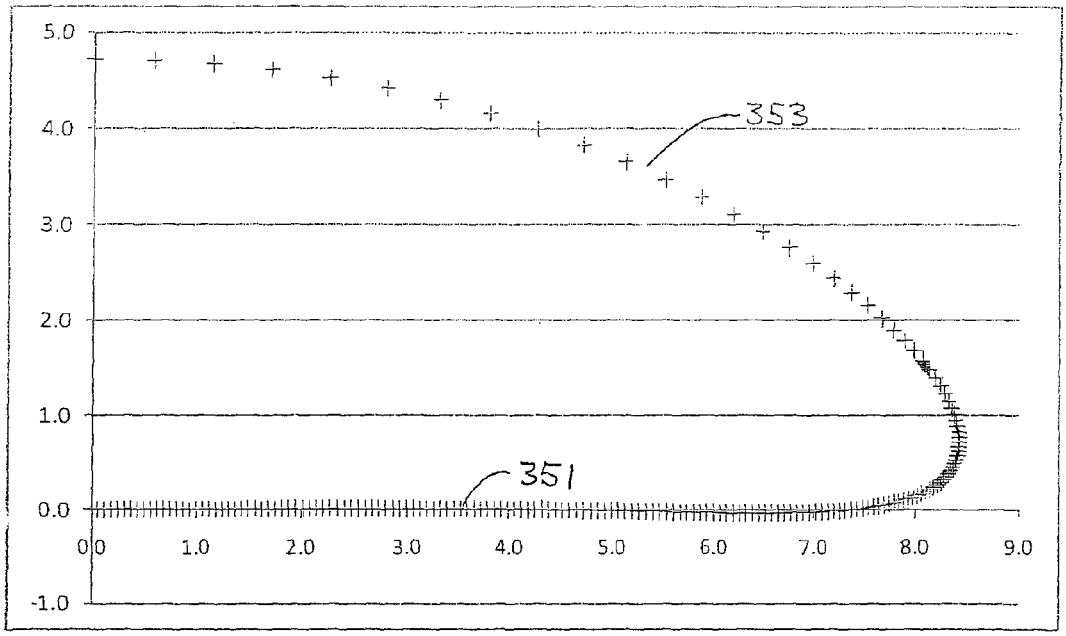
FIG. 19 is a graph of the x and y position of the distal end of the leg relative to the mechanism chassis for a sequence of equally spaced crank angle increments from zero to 180 degrees.

FIG. 19 shows a numerical simulation of the distal end 304*a* (foot) motion accounting for the diameter of the foot and the way it rolls on the surface 100 (FIG. 1) during a one-half of a stride 351. The other half is symmetrical with the illustrated half as explained above. Of course the FIG. 19 also includes the motion of the leg 303*a* as constrained by slot 250 and curved surfaces 306*a*, 306*b*.

Figure 20:
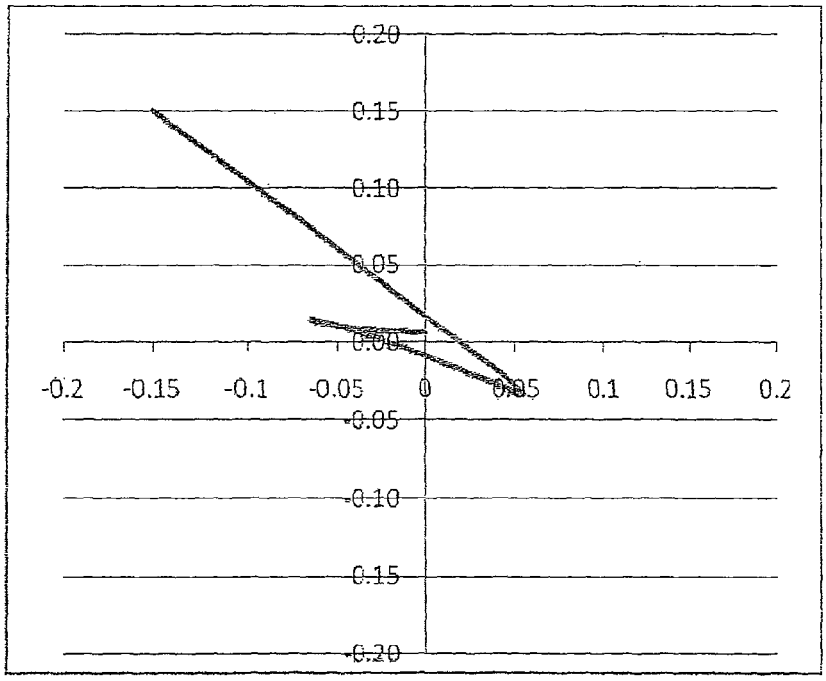
FIG. 20 is a graph of the x and y position difference between the position of the distal end of the leg and the position of an ideal point moving in uniform rectilinear motion.

FIG. 20 shows an example motion of the distal end 304*a* (foot) relative to a fixed point on a surface 100 (FIG. 1) as the example walking device 1000 walks by. From this FIG. 20, it can be seen that errors in the approximation of uniform rectilinear motion amount to about 0.05 inch maximum over the stride portion 351 of the distal end 304*a* movement. This illustrated case represents an example toy robot bug 1000 approximately 2 inches long.

The critical dimensions that define leg motion in this invention are similar to the U.S. Pat. No. 6,866,557. However, in this example case, the motion of the leg 303*a* is not constrained by a perfectly linear slot as in U.S. Pat. No. 6,866,557. Instead, the gaps 250, 550 guide leg 303*a* and interfaces with curved surfaces 306*a*, 306*b*. Although this motion differs slightly with respect to the motion obtained by an ideal linear slot of the U.S. Pat. No. 6,866,557, still numerical optimization can result in motion that closely approximates ideal rectilinear motion.

Determination of the shape of the curves 306*a*, 306*b* and the effects of a spherical distal end 304*a* (foot) can be numerical in nature. An iterative approach successively approximates the required curve while solver techniques are used to adjust the various other parameters to minimize an error function. The error function compares the resultant motion to ideal rectilinear motion. Such numerical techniques are well-known within the capabilities or persons skilled in the art.

Many other features of this embodiment support the mass production of such a toy robot bug as the example 1000 described herein. In this case top housing 200 is a single piece to allow for easy assembly. On a mass production assembly line, the top housing 200 can be placed upside down. In this position, fixturing allows the axels, gears, motors, and legs to be assembled. This approach also simplifies phasing of the legs such that each moves in the correct relation to the remaining legs.

Once all the subcomponents of the mechanism are properly aligned in the top housing 200, the bottom covers 500*a*, and 500*b* can be put in place and the entire mechanical assembly can be fastened together.

The slot or gap method and apparatus for constraining the legs as described herein allow for a robust product with fewer parts that can break or wear out as compared to U.S. Pat. No. 6,866,557.

As illustrated in the cross-sectional view of FIG. 10, the crank gears are arranged above the legs they drive. In this way the weight of the example device 1000 translates forces into the housing 200, 500*a*, 500*b*, but not into the drive gears, which, allows for less friction in the drive train. It also aids in easy assembly.

The foregoing description provides examples that illustrate the principles of the invention, which is defined by the features that follow. Since numerous insignificant modifications and changes will readily occur to those skilled in the art once they understand the invention, it is not desired to limit the invention to the exact example constructions and processes shown and described above. Accordingly, resort may be made to all suitable combinations, subcombinations, modifications, and equivalents that fall within the scope of the invention as described by the features. The words "comprise," "comprises," "comprising," "include," "including," and "includes" when used in this specification, including the features, are intended to specify the presences of stated features, integers, components, or steps, but they do not preclude the presence or addition of one or more other features, integers, components, steps, or groups thereof. The terms upper, upwardly, lower, bottom, top, down, downwardly, vertical, horizontal, over, under, and other directional terms in this description are in reference to the diagrammatic orientations depicted in the drawings and are only used for convenience and clarity in this description unless otherwise indicated.

The invention in which an exclusive property of privilege is claimed is defined as follows:

1. An ambulatory apparatus, comprising:

a plurality of cranks mounted rotatably in a body, wherein the body has an opening adjacent each of the cranks with top, bottom, left side, and right side lateral bearings defining the openings and wherein the left side bearing and the right side bearing each terminates in a radius to form a gap between the radii of the left side bearing and the right side bearing; and a plurality of legs, wherein each of the legs has a length dimension and a width dimension, and wherein a proximal end of each of the legs is connected to a respective one of the cranks and extends in a lengthwise direction of the leg through the opening to a distal end of the leg outside of the body in such a manner that the top, bottom, left side, and right side bearings bear on respective top, bottom, left side, and right side surfaces of the leg between the proximal end and the distal end in a manner that constrains movement of the leg in a lateral direction of the leg in the opening but allows the leg to move inwardly and outwardly in the lengthwise direction of the leg through the opening as the crank rotates, and wherein each leg has a width that varies between a concave curved left lateral side surface and a concave curved right lateral side surface positioned in the gap, wherein the shapes of the concave curved left lateral side surface and the concave curved right lateral side surface vary the width of the leg in a manner that provides practically zero clearance between the leg in the gap and the left side bearing and the right side bearing to maintain a fixed virtual pivot axis of the leg in the gap for more than one-half of a 360 degree rotation of the crank as the crank moves the leg inwardly and outwardly in the lengthwise direction of the leg through the opening.

2. The apparatus of claim 1, wherein the shapes of the concave curved left lateral side surface and the concave curved right lateral side surface vary the width of the leg in a manner that provides practically zero clearance between the leg in the gap and the left side bearing and the right side bearing to maintain a fixed virtual pivot axis of the leg in the gap for at least 300 degrees of a 360 degree rotation of the crank as the crank moves the leg inwardly and outwardly in the lengthwise direction of the leg through the opening.

3. A method of providing ambulatory motion for a device, comprising:

mounting a plurality of rotatable cranks in a housing that has a plurality of gaps such that each crank is adjacent to a respective one of the gaps and each of the gaps is formed by a pair of lateral side bearings that terminate in juxtaposed radii on opposite sides of the gap;

extending a plurality of legs, each of which has a length dimension and a width dimension, in a lengthwise direction of the leg through respective ones of the gaps, and connecting proximal ends of the legs to the respective ones of the cranks such that distal ends of the legs are disposed outside the housing, wherein each of the legs has opposite, concave curved, lateral guide surfaces that are shaped in a manner that varies the width of the leg to provide practically zero clearance in the gap between the leg and the lateral side bearings to maintain a fixed virtual pivot axis of the leg in the gap during lit least one half of a revolution of the crank while accommodating reciprocating movement of the leg in the lengthwise direction of the leg through the gap; and rotating at least one of the cranks to motivate the leg that is connected to that crank to move in a reciprocating manner in the lengthwise direction of the leg through the gap as the leg pivots in the gap as constrained by the lateral sides of the gap.

4. The method of claim 3, including providing each leg with a shape that extends in the lengthwise direction of the leg outwardly through the gap perpendicular to a crank pin that is connected to the proximal end of the leg and with a portion outside the gap that extends at an angle other than perpendicular to the crank pin to the distal end, and tilting the crank and the portion of the leg that extends through the gap at an angle to a support surface on which the device ambulates.

5. An apparatus for moving a distal end of a lever that has a length and a width and which has a medial portion between a proximal end and the distal end, comprising a rotatable crank mechanism including a crank that is rotatable about an axis of rotation and that is pivotably connected to the proximal end of the lever, and an opening in a body through which the medial portion of said lover extends in a lengthwise direction of the lever and in which the medial portion of the lever is constrained by portions of the body that bound the opening with juxtaposed terminal radii on opposite sides of the opening against movement of the medial portion of the lever in a lateral direction in the opening, but able to pass in the lengthwise direction of the lever inwardly and outwardly through the opening in relation to the body, wherein the medial portion of the lever has opposite, concave curved, lateral guide surfaces that are shaped in a manner that varies the width of the medial portion of the lever to provide practically zero clearance in the opening between the lever and the juxtaposed terminal radii of the opening to maintain a fixed virtual pivot axis of the lever in the opening during more than one-half of a revolution of the crank while accommodating reciprocating movement of the lever in the lengthwise direction of the lever through the opening.

6. The apparatus of claim 5, wherein the opening between the juxtaposed radii is a gap fixed with respect to the axis of rotation of said rotatable crank mechanism.

7. The apparatus of claim 5, wherein a constant angular velocity of the crank mechanism results in a constant linear velocity of the distal end of the lever.

8. The apparatus of claim 7 wherein a path traced out by the distal end of the lever approximates a straight line.

9. The apparatus of claim 8 wherein the constant linear velocity and straight-line motion of the distal end of the lever in response to constant angular velocity of the crank mechanism occurs simultaneously and over the more than half of a revolution of the crank mechanism.

10. A locomotive apparatus for supporting and moving a body on a support surface, including a plurality of legs extending from the body, wherein each of the legs comprises a lever that has a length and a width, and that has a proximal end pivotally connected to a crank mechanism and extends in a lengthwise direction of the lever through an opening in the body to a distal end such that a medial portion of the lever between the proximal and distal ends is slidable in the opening in relation to the body in the lengthwise direction of the lever, whereby the medial portion of the lever is constrained by juxtaposed terminal radii of the body that bounds the opening against movement of the lever transverse to the lengthwise direction of the lever but able to pass inwardly and outwardly in relation to the body through the opening in the lengthwise direction of the lever, wherein the distal end of the lever is adapted for supporting and moving the body on the support surface, and wherein the medial portion of the lever has opposite, concave curved, lateral guide surfaces that are shaped in a manner that varies the width of the medial portion of the lever to provide practically zero clearance in the opening between the lever and the juxtaposed terminal radii of the opening to maintain a fixed virtual pivot axis of the lever in the opening during more than one-half of a revolution of the crank while accommodating reciprocating movement of the lever in the lengthwise direction of the lever through the opening.

11. The locomotive apparatus of claim 10 wherein the juxtaposed terminal radii define a gap fixed with respect to the body.

12. The locomotive apparatus of claim 10 wherein the distal end of the lever moves in a straight line transverse to the lengthwise direction of the lever in response to rotation of the crank mechanism.

13. The locomotive apparatus of claim 12 wherein constant angular velocity of the crank mechanism produces constant linear velocity of the distal end of the lever in the straight line.

14. An ambulatory apparatus, comprising:

a body that has a plurality of openings, each of which openings has a top bearing surface, a bottom bearing surface, a left lateral side bearing surface, and a right lateral side bearing surface, the left lateral side bearing surface and the right lateral side bearing surface each having a terminal radius juxtaposed and spaced apart from each other in a manner that provides a gap between the lateral right side bearing surface and the lateral left side bearing surface;

a plurality of cranks mounted on the body adjacent to respective ones of the plurality of openings, each of the cranks being mounted in a manner such that the crank is rotatable with respect to the body about a respective axis of rotation, wherein each crank has a crank pin positioned radially outward from the axis of rotation such that rotation of the crank about the axis of rotation causes the crank pin to rotate in a circular orbit around the axis of rotation at a radial distance outward from the axis of rotation; and a plurality of legs, each of which legs has an elongated portion between a proximal end of the leg and a distal end of the leg that extends in a lengthwise direction of the leg through the gap in a respective one of the openings in the body such that a proximal end of the leg is positioned in the body and a distal end of the leg is positioned outside of the body, the proximal end of the leg being pivotally connected to the crank pin of the crank that is adjacent to the opening such that rotation of the crank about the axis of rotation imparts reciprocating motion to the leg that moves the leg in the lengthwise direction of the leg through the gap in relation to the body while the juxtaposed right side lateral bearing and the left side lateral bearing constrain the leg against lateral movement in the gap, thereby causing movement of the leg both pivotally in relation to the body and inwardly and outwardly in relation to the body in the lengthwise direction o the leg, wherein each leg has a width that varies between a concave curved left lateral side surface and a concave curved right lateral side surface positioned in the gap, wherein the shape of the concave curved left lateral side surface and the concave curved right lateral side surface vary the width of the leg in a manner that provides practically zero clearance between the leg in the gap and the left side bearing and the right side bearing to maintain a fixed virtual pivot axis of the leg in the gap for more than one-half of a 360 degree rotation of the crank as the crank moves the leg inwardly and outwardly in the lengthwise direction of the leg through the opening.

* * * * *